United States Patent [19]

Lee

[11] Patent Number: 4,721,598

[45] Date of Patent: Jan. 26, 1988

[54] POWDER METAL COMPOSITE AND METHOD OF ITS MANUFACTURE

[75] Inventor: Peter W. Lee, Canton, Ohio

[73] Assignee: The Timken Company, Canton, Ohio

[21] Appl. No.: 11,751

[22] Filed: Feb. 6, 1987

[51] Int. Cl.[4] ..... B22F 7/00

[52] U.S. Cl. ..... 419/8; 419/38; 419/39; 428/557; 428/558

[58] Field of Search ..... 419/38, 8, 39; 428/557, 428/558

[56] References Cited

U.S. PATENT DOCUMENTS

| | | | |
|---|---|---|---|
| 3,320,663 | 5/1967 | Haller | 29/420 |
| 3,324,544 | 6/1967 | Haller | 29/521 |
| 3,665,585 | 5/1972 | Dunn et al. | 29/420 |
| 3,762,881 | 10/1973 | Dunn | 29/191 |
| 3,768,327 | 10/1973 | Dunn et al. | 74/434 |
| 3,772,935 | 11/1973 | Dunn et al. | 74/434 |
| 3,803,702 | 4/1974 | Bratt et al. | 419/8 |
| 4,025,313 | 5/1977 | Slaats | 419/8 |
| 4,054,449 | 10/1977 | Dunn et al. | 75/208 R |
| 4,145,798 | 3/1979 | Sarnes | 29/148.4 R |

*Primary Examiner*—Stephen J. Lechert, Jr.
*Attorney, Agent, or Firm*—Gravely, Lieder & Woodruff

[57] ABSTRACT

A powder metal composite made up of first and second powder metal bodies assembled in a mold cavity with the bodies separated by a divider ring and with the bodies being in concentric relationship such that the assembled bodies and divider ring can be simultaneously compacted and subsequently simultaneously sintered to form the desired composite metal article. In practicing the method of forming a composite metal article one of the bodies may be selected from a base powder metal and the other body may be selected from a high performance alloy powder metal, and the divider ring may be selected from a low melting point metal such as copper that will dissolve itself into the powders during sintering and enhance mechanical properties of the sintered compact article. The composital metal article may be used as it is if the density for its intended uses is satisfactory, or such article may be further densified by being subjected to an additional hot forging operation with the article sintered thereafter if deemed necessary.

8 Claims, 3 Drawing Figures

POWDER METAL COMPOSITE AND METHOD OF ITS MANUFACTURE

BACKGROUND OF THE INVENTION

1. Field of the Invention

This invention relates to the making of composite articles with different metallic powders, and to the method of forming such composite articles.

2. Description of the Prior Art

The presently known pertinent prior art in powder metallurgy, in relation to load bearing composites, have two characteristically different metallic powders joined to form a single composite article, is represented by a group of U.S. Pat. Nos. 3,665,585, 3,762,881, 3,768,327, 3,772,935, 4,054,449 and 4,145,798 which is the work of William M. Dunn and co-inventors between 1970 and 1977. That work in the field was preceeded by the work of John Haller disclosed in U.S. Pat. Nos. 3,320,663 and 3,324,544 of 1967. This development of powder metallurgy for making load sustaining composite articles is believed to stem from the need to develop articles at significantly lower costs. Heretofore, load sustaining articles had been machined from metallic blanks followed by suitable heat treatment. A high rate of scrap parts has resulted, so there has been good reason to pursue powder metallurgy to realize savings therefrom.

BRIEF DESCRIPTION OF THE INVENTION

An important object of the present invention is to provide a method for making powder metallurgy composite components in the form of cups and cones for bearings.

A further important object of this invention is to produce powder metal composites by assemblying two different metallic powders in a mold separated by a divider element that remains in place between the two metallic powders during the compacting and the following sintering steps.

Other objects of the present invention are to improve on the prior art by avoiding the need to form and compact two substrates and then bring them together in a sintering unification, to improve on the prior art technique of using a divider to deposit two different powders in a mold and then removing the divider which disturbs the interface in the compacted preform, and to improve on the prior art by reducing cycle time in the manufacture Of powder metal components and reduce production costs at the same time.

It is an additional object to select a divider that can be dissolved during the sintering step, such divider being a low melting point metallic material, copper being one for example enhancing mechanical properties of the sintered part, or it may be an organic material.

BRIEF DESCRIPTION OF THE DRAWINGS

The present invention is best exemplified by embodiments as depicted in the following drawings, wherein.

DETAILED DESCRIPTION OF THE EMBODIMENTS

Figure 1:
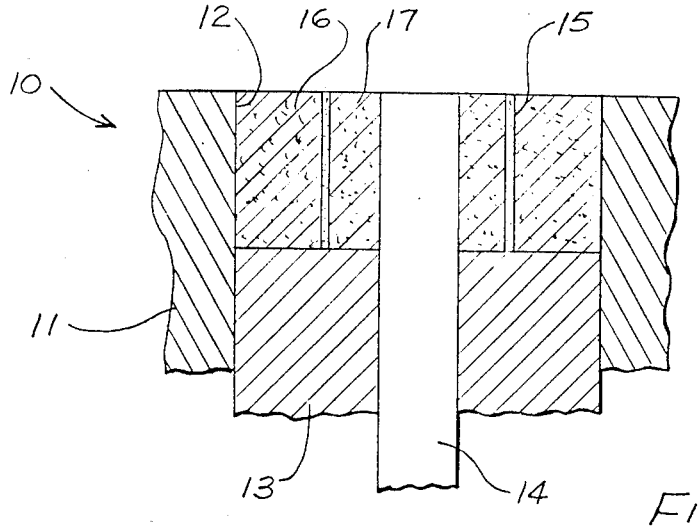
FIG. 1 is a diagrammatic vertical section through a mold cavity in which a suitable cavity is formed around a core rod prior to compacting the powder metals.

In FIG. 1, a mold 10 comprises an outer ring 11 that forms a molding cavity 12 that has a bottom closure ram 13, and an inner core rod 14 that occupies the central space of the cavity 12. The cavity receives a divider ring 15 which separates an inner annular space from an outer annular space. The inner and outer annular spaces are filled with different metallic powders. Depending on the use to which the end product is to be put it may be that one of the bodies of powder 16 can be relied upon to form a load bearing surface and the other of the bodies of powder 17 can be a backup body of less expensive metallic powder. Special service bodies exposed to high temperature, highly corrosive environments or high wear applications, can employ high temperature and/or high performance powder alloy steels for one of the bodies 16. Less expensive alloy steel powder, or base metal can be used for the other of the bodies 17. The result of this flexible choice of metallic powders is improved performance and economic benefits. Of course, the inner and outer bodies of metal powders can be switched to reverse their position in the cavity 12.

Figure 2:
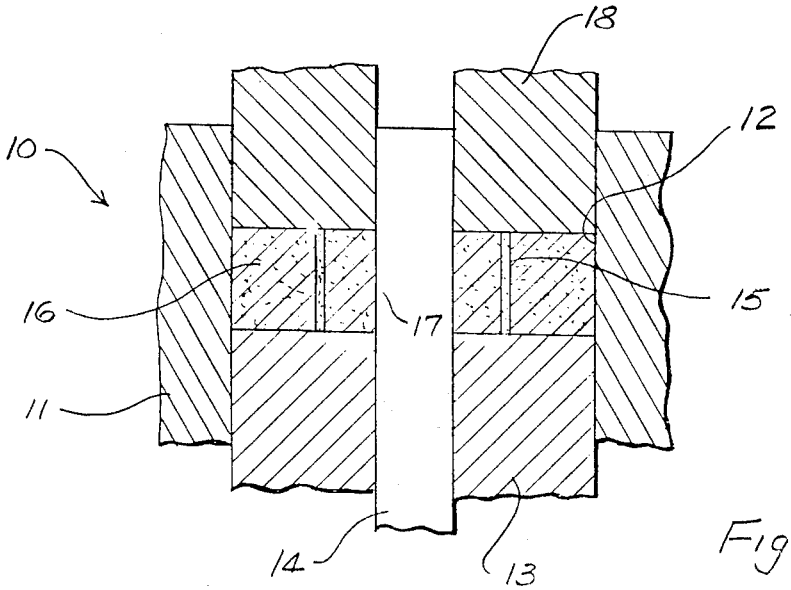
FIG. 2 is a diagrammatic vertical section of the step of compacting the powder metals with the divider ring in place.
Figure 3:
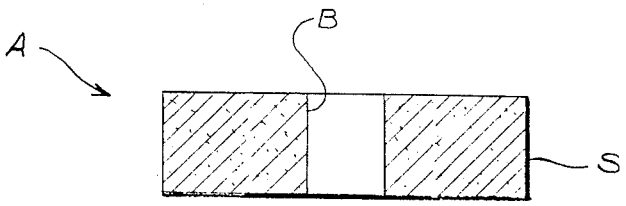
FIG. 3 is a vertical section of the powder metal composite after sintering.

The method is practiced by selecting different powders 16 and 17, and with the divider ring 15 isolating these powders from each other,, these powders are assembled in the mold cavity 12 (see FIG. 2). Thereafter a compaction ram 18 can be brought down on the top of the cavity 12 in opposition to the bottom closure ram 13. This step can be performed at room temperature. The compaction pressure level may range from about 35 tons to about 60 tons per square inch, depending on the chemistry of the powders. The temperature during the sintering step which follows the compaction step will also depend upon the chemistry of the powders. A typical range of temperature is of the order of about 1800° F. to about 2200° F. The sintered preform may or may not be hot forged depending on the application at a pressure of the order of 80 to 100 tons per square inch. A typical range of hot forging temperature is 1800°-2000° F. The sintered composite article A is shown in FIG. 3 wherein the inner load bearing surface B is backed up by outer base metal surface S.

It is to be recognized that the divider ring 15 has a primary function to keep the two different powders separated until compaction takes place, and it is not intended to be removed as that would disturb the interface zone between the different powders. The divider 15 can be a low melting point metal such as copper that will dissolve itself into the powders during sintering and enhance mechanical properties of the sintered compacts. In some instances an organic material for the divider ring 15 can be employed, such as paper or plactics. These organic materials will be dissipated during the sintering stage in the production method.

The present invention is practiced by filling a die cavity 12 with two different powders 16 and 17, separated by a divider ring 15, and simultaneously compacting the powders with the divider ring in place to obtain a desired densification of the powders, followed by simultaneously sintering the two powders to effect uniting of the powders across the divider ring. This method results in a composite body, irrespective of the chemical and metallurgical characteristics of the two powders.

The present invention differs from the presently known prior art in several important ways, such as:

(a) The prior art either requires compact preforms with different powders separately compacted and followed by separate sintering, or filling a die cavity with different powders separated by a divider ring which is removed prior to compacting, (b) joining two different preforms, which are separately compacted and separately sintered, by a hot forging process, which forging step may occur without sufficient cleaning of the faces to be joined, thereby interferring with metallurgically sound bonding.

Avoiding the foregoing procedures of the prior art will decrease cycle time, reduce production costs, and including the divider ring 15 of a copper sheet will enhance the mechanical properties of the finished part by being dissolved into the matrix. Further, the finished article A may be a combination of a base metal and a high performance alloy metal, both being in powder form and separated by the ring or sleeve in the beginning.

While the invention has been set forth in connection with a preferred embodiment, it is to be understood that the disclosure is not intended to limit the scope of the invention, except as it may be so limited by the prior art.

What is claimed is:

1. A composite metal article comprising a first body of a base powder metal; a second body of a high performance alloy powder metal; and a divider ring; said first and said second bodies being in concentric relationship and in powder form with said divider ring isolating the powder form of said first and second bodies, and said first and second bodies and siad divider ring being first simultaneously compacted and subsequently simultaneously sintered to form the said composite metal article.

2. The composite metal article of claim 1 wherein said first body is concentrically inside said second body.

3. The composite metal article of claim 1 wherein said second body is concentrically inside said first body.

4. A method of making a composite metal article comprising the step of confining a mass of a first powder metal and second powder metal when in powder form in a common enclosing compacting molding cavity; disposing a divider between said power metals at the time of placement of the first and second powders for initially isolating the powder metals from each other; simultaneously compacting the powder metals and the divider in the compacting molding cavity; and simultaneously sintering the powder metals and the divider to form the composite metal article.

5. A method of fabricaating a composite powdered metal article comprising:

(a) forming up first and second bodies of different powdered metals into a common composite shape with one body surrounding the other body, (b) dividing the first and second bodies of different powered metals such that the different powered metals are isolated and thereby prevented from initially contacting each other;

(c) subjecting the different powdered metal while divided to a step of simultaneous compaction for densifying the powder metals; and (d) subjecting the compaction densified different powered metals to a common sintering temperature for uniting said different divided powder metals to each other by simultaneously incorporating the divided first and second powered metal bodies into a composite article.

6. A method of making a composite metal article comprising selecting different powder metals for the finished composite article, assembling the selected different powder metals in a molding die cavity while isolating the powder metals to arrest migration into each other while in the powder state, applying a compacting ram on the die cavity to apply a pressure ranging from about 35 tons to as much as 60 tons per square inch, sintering the thus compacted powder metal at a temperature of the order of about 1800° F. to about 2200° F. to unite the powder metals across the interface to produce a finished composite metal article.

7. The method set forth in claim 6 including placing a divider ring between the two powder metals to isolate the same from each other and to dissolve into the powder metals during sintering.

8. The method set forth in claim 6 including placing a divider ring of a low melting point metal between the two powder metals to initially isolate the same from each other and to subsequently dissolve into the powder metals and enhance mechanical properties in the sintered finished composite metal article.

* * * * *